US010939772B2

(12) United States Patent
Stewart et al.

(10) Patent No.: US 10,939,772 B2
(45) Date of Patent: Mar. 9, 2021

(54) PILLOW SYSTEM

(71) Applicant: Chiropractic Family Line, LLC, Hendersonville, TN (US)

(72) Inventors: Clare Stewart, Hendersonville, TN (US); Susan Pattee, Indianapolis, IN (US)

(73) Assignee: Chiropractic Family Line, LLC, Hendersonville, TN (US)

( * ) Notice: Subject to any disclaimer, the term of this patent is extended or adjusted under 35 U.S.C. 154(b) by 198 days.

(21) Appl. No.: 15/919,957

(22) Filed: Mar. 13, 2018

(65) Prior Publication Data

US 2018/0263375 A1 Sep. 20, 2018

Related U.S. Application Data

(60) Provisional application No. 62/471,879, filed on Mar. 15, 2017.

(51) Int. Cl.

| | |
|---|---|
| ***A47C 20/02*** | (2006.01) |
| ***A47G 9/02*** | (2006.01) |
| ***A47G 9/10*** | (2006.01) |
| ***A61H 37/00*** | (2006.01) |

(52) U.S. Cl.

CPC ..... *A47C 20/025* (2013.01); *A47G 9/0253* (2013.01); *A47G 9/1054* (2013.01); *A61H 37/00* (2013.01); *A47G 2009/1018* (2013.01); *A61H 2201/169* (2013.01); *A61H 2201/1645* (2013.01); *A61H 2203/0468* (2013.01); *A61H 2205/083* (2013.01)

(58) Field of Classification Search

CPC .... A47C 20/025; A47C 27/148; A61H 37/00; A61H 2201/169; A61H 2203/0468; A61H 2009/1018; A61H 2205/083; A47G 9/1054; A47G 9/0253; A47G 9/1063; A47G 9/109

USPC ..... D6/601

See application file for complete search history.

(56) References Cited

U.S. PATENT DOCUMENTS

| | | | | |
|---|---|---|---|---|
| 3,118,152 A * | 1/1964 | Talley, Jr. | ..... | A47C 20/025 5/631 |
| 3,333,286 A * | 8/1967 | Biolik | ..... | A47G 9/10 5/632 |
| 3,378,862 A * | 4/1968 | Skinner | ..... | A47C 20/025 5/722 |
| 4,944,059 A * | 7/1990 | Wall | ..... | A47C 20/025 5/631 |

(Continued)

OTHER PUBLICATIONS

Belly Pillow; www.bellypillow.com/content/belly-pillow-set; Mar. 3, 2016.

(Continued)

*Primary Examiner* — Robert G Santos
*Assistant Examiner* — Alison N Labarge
(74) *Attorney, Agent, or Firm* — Brannon Sowers & Cracraft PC

(57) ABSTRACT

A pillow system includes a pillow assembly and a pillow and pillow cover assembly, the pillow assembly having a base attached to a pillow having an opening, the pillow formed of a first foam material, and the base formed of a second foam material, and wherein the first foam material is more rigid than the second foam material. The pillow and pillow cover assembly includes a pillow cover formed of a stretchy fabric material capable of stretching into the opening of the pillow during use.

16 Claims, 4 Drawing Sheets

(56) References Cited

U.S. PATENT DOCUMENTS

| | | | | |
|---|---|---|---|---|
| 5,400,449 | A | 3/1995 | Satto | |
| 5,642,543 | A * | 7/1997 | Huntley | A47G 9/10 5/490 |
| 6,018,831 | A * | 2/2000 | Loomos | A47G 9/10 5/490 |
| 6,446,288 | B1 * | 9/2002 | Pi | A47G 9/10 5/636 |
| 8,205,286 | B1 * | 6/2012 | Diaz | A47C 20/026 5/630 |
| 9,072,391 | B1 * | 7/2015 | Jordan | A47C 27/146 |
| 2004/0237199 | A1 * | 12/2004 | Hirst | A47C 20/025 5/631 |
| 2015/0296995 | A1 * | 10/2015 | Krim | A47C 27/15 5/724 |
| 2016/0266092 | A1 * | 9/2016 | Krockenberger | G01N 15/1459 |

OTHER PUBLICATIONS

The Sophie Prone Pregnancy Cushion (Professional Version); https://www.amazon.com/Sophie-Pregnancy-Cushion-Professional-Version/dp/B005E1F7F8; Mar. 3, 2016.

The Preggo Pillow Drs Version; http://chirocity.com/Pregnancy-Pillow-Pregnancy-Pillows-Drs-Version.aspx; Mar. 3, 2016.

Massage Therapy Model—Pregnancy Plus Pillows; http://www.chirovantage.ca/expecting-moms/new-massage-therapy-model-pregnancy-plus-pillows-2pc-set/; Mar. 3, 2016.

Handmade PregoPillows; http://www.optimizedlivinginstitute.com/pregopillow; Mar. 3, 2016.

Zenith Pregnancy Pillow; http://chirocity.com/massagingbathpillow.aspx; Mar. 3, 2016.

* cited by examiner

PILLOW SYSTEM

CROSS-REFERENCE

This application claims the benefit of U.S. Provisional Patent Application No. 62/471,879 titled "PILLOW SYSTEM," to Clare Stewart and Susan Pattee, filed Mar. 15, 2017, the entire disclosure of which is expressly incorporated by reference herein.

TECHNICAL FIELD

The present disclosure relates generally to body pillows, support pillows, and other positioning aids used in the healthcare field and, more particularly, to pillow systems for use in supporting a pregnant woman in a prone position for chiropractic treatment, massage treatment, or the like.

BACKGROUND

Medical treatment of pregnant women has long required specialized equipment to accommodate the unique and rapidly changing physical profiles of the patients. Treatment of pregnant women has been especially problematic in medical fields that involve treatment of the musculoskeletal system, such as chiropractic, massage, or acupuncture therapy, as such treatments often require the patient to lay in a prone position for an extended period of time. The prone position causes pressure in the patient's abdominal region, which is often uncomfortable for pregnant women and may even lead to injury in the lower back and pelvic girdle regions, amongst other things.

Attempts have been made to improve the comfort of pregnant women during chiropractic treatment. Several such attempts involve custom formed pillows designed to allow pregnant women to assume the prone position without causing undue stress on the abdominal region of the patient. One known design is disclosed in U.S. Pat. No. 5,400,449 to Satto ("Satto"). Satto discloses an adjustable pregnancy cushion that can apparently be configured to accommodate pregnant women in the prone position at different stages of pregnancy. While this and other solutions may help to prevent pressure concentration in the abdominal region in some instances, improved or alternative strategies remain desirable.

SUMMARY OF THE INVENTION

In one aspect, a pillow assembly includes a pillow formed of a first foam material and has a body defining an opening extending through the body between a top surface and a bottom surface, the top surface and the bottom surface being substantially planar and substantially parallel with each other. The pillow assembly also has a base having a top surface and being formed of a second foam material, the top surface of the base having a continuous extent coextensive with and attached to the bottom surface of the pillow, and wherein the first foam material is rigid relative to the second foam material.

In another aspect, a pillow and pillow cover system includes a pillow assembly including a pillow having a body formed of a first foam material with an opening extending therethrough for receiving a pregnant woman's abdomen, and a base formed of a second foam material, the first foam material being more rigid than the second foam material.

The pillow cover system further includes a pillow cover formed of a stretchy fabric material receiving the pillow assembly.

In still another aspect, a pillow system includes a first pillow formed of a first foam material, a second pillow formed of the first foam material and structured for positioning on top of the first pillow, a base formed of a second foam material and attached to a bottom side of the first pillow, the first foam material being more rigid than the second foam material. The pillow system also has a first pillow cover receiving the first pillow and the base, the first pillow cover being formed of a stretchy fabric material, and a second pillow cover formed of the stretchy fabric material receiving the second pillow.

DETAILED DESCRIPTION

Figure 1:
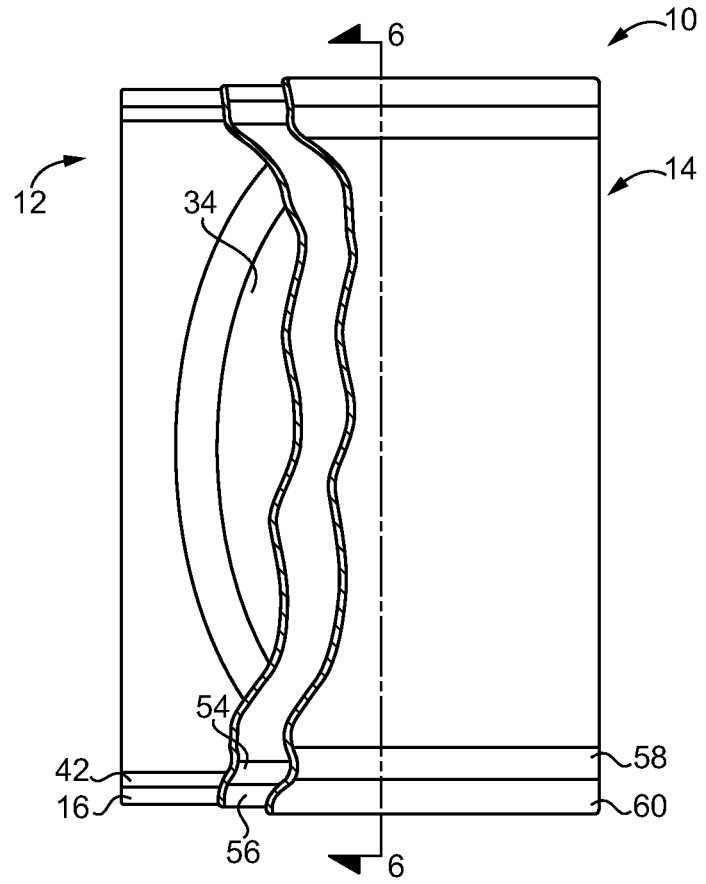
FIG. 1 is a top diagrammatic view of a pillow system, according to one embodiment.
Figure 2:
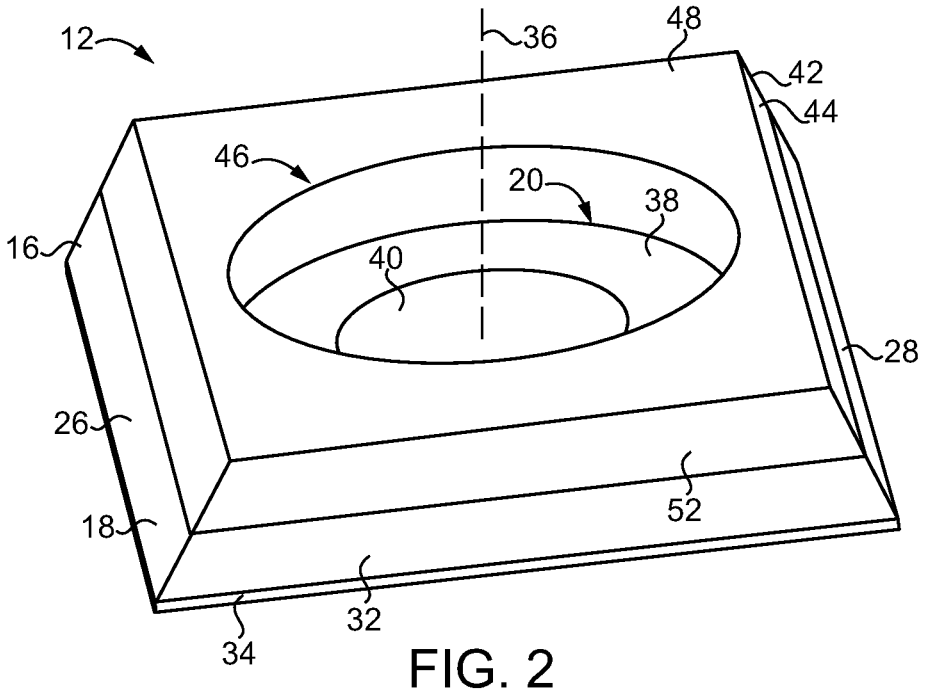
FIG. 2 is a perspective view of a pillow assembly, according to one embodiment.
Figure 3:
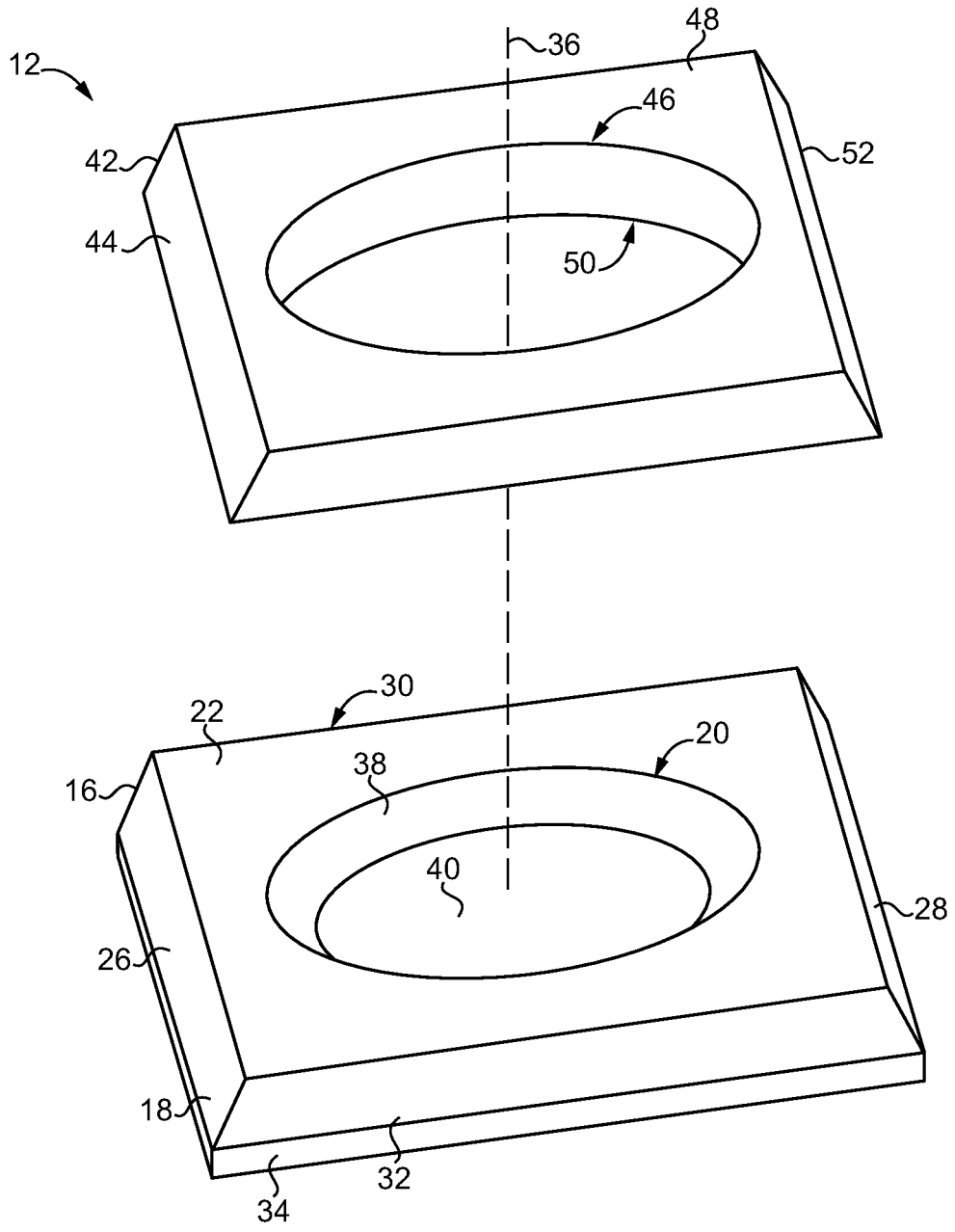
FIG. 3 is an exploded view of a pillow assembly, according to one embodiment.
Figure 4:
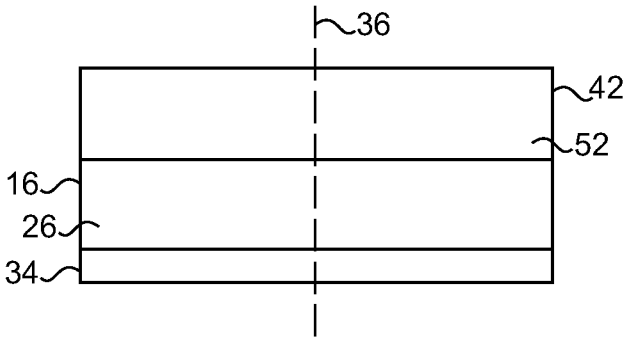
FIG. 4 is a plan view of a pillow assembly, according to one embodiment.
Figure 5:
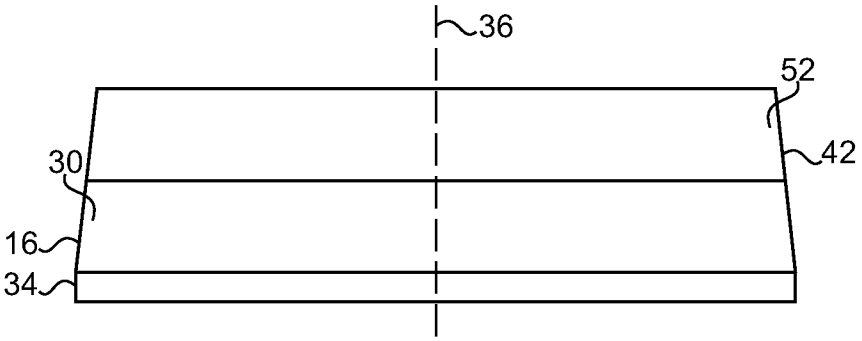
FIG. 5 is a plan view of a pillow assembly, according to one embodiment.

Referring now to FIG. 1, a top plan view of a pillow system 10 including a pillow assembly 12, and a pillow and pillow cover system 14 (hereinafter "cover system 14") is shown according to one embodiment. Referring also to FIGS. 2 and 3, perspective and exploded views of pillow assembly 12 without cover system 14 are shown, respectively. Pillow assembly 12 includes a first pillow 16 formed of a first foam material and includes a body 18 defining an opening 20 extending through body 18 between a top surface 22 and a bottom surface 24 (not visible in FIGS. 2 and 3). Top surface 22 and bottom surface 24 may both be substantially planar and substantially parallel with each other. Body 18 has a plurality of side surfaces extending between top surface 22 and bottom surface 24, including a front surface 26, a back surface 28, a right surface 30, and a left surface 32. The terms "top" and "bottom," "right" and "left," and "front" and "back" are used herein in a relative sense, each in relation to each other when viewing pillow system 10 and/or pillow assembly 12, and should not necessarily be taken to mean that pillow system 10 or pillow assembly 12 has a particular orientation. Referring now also to FIGS. 4 and 5, side views of pillow assembly 12 illustrating front surface 26 and right surface 30, respectively, are shown. Pillow assembly 12 has a rectangular shape when viewed from above (as seen in FIG. 1) or below (not shown) such that front surface 26 is identical in size, shape, and orientation to back surfaces 28, and right surface 30 is identical in size, shape, and orientation to left surface 32, although different embodiments may have a different polygonal shape, a circular or oblong shape, or any other suitable shape. Front surface 26 and back surface 28 are substantially planar and slope downward from top surface 22 to bottom surface 24 at an angle such that a length of right surface 30 and of left surface 32 is greater adjacent to bottom surface 24 than at or adjacent to top surface 22. Front surface 26 and back surface 28 may slope downward at an angle less than 45 degrees, and more particularly from about 5 degrees to about 25 degrees, relative to a longitudinal axis 36 extending between top surface 22 and bottom surface 24. In other embodiments, one or more of surfaces 26, 28, 30, 32 may be contoured or curved, or may be substantially parallel with longitudinal axis 36.

Opening 20 has an oblong shape for receiving a pregnant woman's abdomen with body 18 defining an inner surface 38 extending between top surface 22 and bottom surface 24 such that inner surface 38 is angled to and slopes downward towards longitudinal axis 36. Inner surface 38 may have a generally oblong frustoconical shape centered about longitudinal axis 36. Pillow openings having the generally oblong frustoconical shape of the present embodiment have been observed to be especially fitting for receiving a patient's distended abdomen and particularly suited to gently and comfortably accommodate a wide range of patients, each of whom may have a uniquely sized or shaped mid-section. As compared with circular-shaped openings, it has been discovered that generally oblong frustoconical-shaped openings more closely conform with the geometry of a typical patient's mid-section, thereby allowing pillow assembly 12 to cradle the patient's abdomen during use without causing undue deformation of pillow assembly 12. Still, embodiments in which opening 20 has a different shape, such as a symmetrical or an asymmetrical polygon, a circular shape, or any other shape suitable for receiving a pregnant woman's abdomen, are also contemplated. In some embodiments, inner surface 38 may be parallel with longitudinal axis 36. In alternative embodiments, inner surface 38 may be defined by a separate piece or pieces structured for positioning within opening 20. In still other embodiments, inner surface 38 may be contoured, curved, or angled relative to longitudinal axis 36.

Pillow assembly 12 further includes a base 34 formed of a second foam material and may have a top surface 40 sized and shaped to be substantially coextensive with bottom surface 24 of first pillow 16 such that base 34 registers with bottom surface 24 and is within a footprint defined by body 18. In contrast to bottom surface 24, which includes opening 20, top surface 40 has a continuous extent. Base 34 is attached to bottom surface 24 by, for example, adhesives such as cyanoacrylates, hot-melt adhesives, polyvinyl acetate, or the like, or by any other suitable means, though, in some embodiments, base 34 may be removably coupled with first pillow rather than fixably attached thereto. Further still, the present disclosure also contemplates embodiments in which base 34 is integral with body 18.

Pillow assembly 12 may also include a second pillow 42 formed of the first foam material or of a foam material having material properties substantially similar to the material properties of the first foam material, as will be discussed hereinafter. Second pillow 42 is similar in shape and configuration to first pillow 16, and includes a body 44 defining an opening 46 extending through body 44 between a top surface 48 and a bottom surface 50. Like top and bottom surfaces 22, 24, top and bottom surfaces 48, 50 may be substantially planar and substantially parallel with each other, although top surface 22 and bottom surface 50 might be non-planar and complementary to each other to fit pillows 16 and 42 together. Body 44 also has a plurality of side surfaces 52 extending between top surface 48 and bottom surface 50, each of the plurality of side surfaces 52 corresponding with one of surfaces 26, 28, 30, 32. Each side surface 52 may be angled between top surface 48 and bottom surface 50 such that the side surface 52 is angled to match the angle of the corresponding surface of first pillow 16. In this way, when pillows 16, 42 are in a stacked configuration (seen in FIG. 2), each side of pillow assembly 12 has a substantially uniform gradient between top surface 48 of second pillow 42 and bottom surface 24 of first pillow 16. In other embodiments, side surfaces 52 may have a different angle than the corresponding surface on first pillow 16. Second pillow 42 is sized and shaped such that bottom surface 48 registers with top surface 22 of first pillow 16. In still other embodiments, first pillow 16 may be structured to register with second pillow 42 when received within a cover, second pillow 42 may be structured to register with first pillow 16 when received within a cover, or both first pillow 16 and second pillow 42 may be structured to register with each other when each are received within a cover.

The first foam material and the second foam material are each foam or foam-like materials structured to support a pregnant woman without collapse of the foam materials or undue deformation of the foam materials from repeated loading and unloading while being sufficiently pliable to contour to the dimensions of the patient such as, for example, a polyurethane foam or polyester foam, or mixtures of these or other polymers. It will be appreciated that some amount of collapse or deformation of the foam materials is expected and can be advantageous, as will become apparent from the discussion hereinafter. Conversely, undue collapse or deformation may include, for instance, collapse that may compromise the structural integrity of pillow assembly 12, defeat its abdomen cradling capability, or that results in plastic deformation, respectively. The first and the second foam materials have different material properties (i.e., intensive properties) independent of each materials' shape, size, or configuration (i.e., extensive properties). Discussion of any properties or characteristics of the first or the second foam materials, or any other materials, should therefore be understood to reference the material and material properties unless otherwise stated. In one respect, the first foam material is more rigid than the second foam material in that the first foam material may be more resistant to deformation, particularly, to compressive deformation. In this way, pillows 16, 42 may largely retain their structural integrity during use while base 34—formed of the second foam material, which is less rigid (i.e., less stiff/more flexible or pliable)—can deform to cradle a pregnant woman's abdomen. The second foam material may also have a softer texture and feel than the first foam material. By way of example, the first foam material may have a density of about 1.8 lbs/ft$^2$ and an indentation force deflection (IFD) (ASTM standard D3574) of about 45 lbs, wherein IFD is one measurement indicative of foam rigidity, with the second foam material having an IFD less than 45 lbs. It will be appreciated that density and IFD are exemplary measurements indicative of foam rigidity and the rigidity of the first and second foam materials may be measured by any other different tests, standards, measurements, or the like, indicative of or correlated with foam rigidity. In still other embodiments, pillows 16, 42 may include additional foam pieces coupled with bodies 18, 44, and/or may include different or additional foam materials, or the shape, size, or configuration of pillows 16, 42 or base 34 may be designed to have certain structural or extensive properties that complement or enhance the relative material properties of the first and second foam materials in a manner consistent with the present disclosure. For example, the first or the second foam materials could have more or less holes or cells that might cause foam materials having similar intensive properties to exhibit different extensive properties, or first pillow 16 or second pillow 42 might include a third material, a fourth material, and so on, with each additional material having a different material property than the first and the second foam materials.

Figure 6:
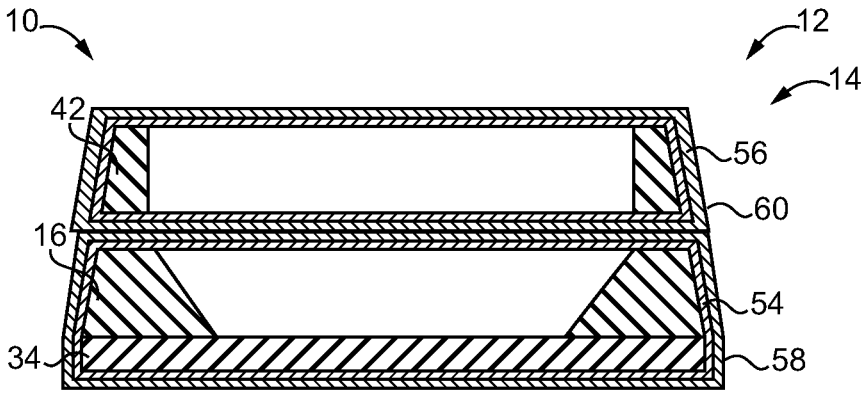
FIG. 6 is a sectioned view of a pillow system, according to one embodiment.

As can be seen in FIG. 1, pillow system 10 includes cover system 14. Referring now also to FIG. 6, a sectioned view of pillow system 10 at line 6-6 of FIG. 1 is shown. Cover system 14 includes a first cover 54 receiving first pillow 16 and base 34. First cover 54 is structured to fit snugly over first pillow 16 and base 34 such that first cover 54 substantially conforms with and is in contact with the outer surfaces of first pillow 16 including surfaces 22, 26, 28, 30, 32 and base 34. In a practical implementation strategy, one or more dimensions of first cover 54 may be less than a corresponding dimension of the first pillow 16/base 34 assembly such that first cover 54 must stretch to receive that assembly. First cover 54 is formed of a first textile or fabric material (hereinafter "first fabric material") structured to stretch in a manner that allows first cover 54 to substantially conform with the contours of body 18 without catching or pulling on the first foam material in a manner that may cause first pillow 16 to collapse or that may otherwise cause first pillow 16 to become deformed during use in a way that unduly compromises the ability of first pillow 16 to support a pregnant woman. The first fabric material may be more flexible or stretchy (i.e., less resistant to elastic deformation) than the first foam material in that a lower force load might cause the first fabric material to experience elastic deformation opposite an applied load than might be required for the first foam material to experience elastic or plastic deformation. Put differently, the first fabric material might stretch responsive to a load force before the first foam material compresses or experiences any other type of observable deformation. In this way, pressure exerted on pillow system 10 can be diffused by first cover 54 in a manner that can limit crushing or deforming first pillow 16 or second pillow 42.

Cover system 14 may also include a second cover 56 receiving second pillow 42. Second cover 56 is substantially similar to first cover 54 except that second cover 56 is sized and shaped to receive second pillow 42. Like first cover 54, second cover 56 is formed of the first fabric material so that second cover 56 can substantially conform with the contours of body 44 without catching or pulling on the first foam material of second pillow 42 in a way that may cause second pillow 42 to collapse or become unduly deformed. In some embodiments, first cover 54 and second cover 56 may be formed of a different type of first fabric material wherein one of covers 54, 56 may be more stretchy than the other, or wherein one of covers 54, 56 may be less resistant to elastic deformation.

The first fabric material is formed of lightweight, stretchy fibers such that the material can stretch in a manner consistent with the present disclosure. For instance, as discussed above, the first fabric material is stretchy relative to the first foam material such that the first fabric material may stretch to give way to and to support a pregnant woman's abdomen before the first foam material experiences structural deformation. The first fabric material may be a single layer, single fiber textile having a stretch percentage of 65% or more in at least one direction and a weight of less than 8 ounces per yard (i.e., approximately 271 GSM). More particularly, the first fabric material may have a stretch percentage of 75% or greater and a weight of about 3 ounces per yard (i.e., approximately 102 GSM), such as a single layer polyester fabric. Stretch percentage can be calculated through use of the following formula:

$$(W_{Max}/W-1)\times 100$$

wherein W is the width of a piece of a fabric material and $W_{Max}$ the width of the same piece of fabric material when stretched to its maximum in the direction of the width measurement. In an embodiment, the first fabric may be, for example, a 100% polyester fabric (i.e., formed entirely of polyester fibers) such as the Jet Set line of fabrics from Sew Classics™. In other embodiments, the first fabric could be formed of an elastomeric fiber or of a blend of elastomeric fibers such as a polyester/spandex blend, a cotton/spandex blend, a rayon/polyester/spandex blend, or any other suitable type of fabric material or blend of fabric materials. First cover 54 and second cover 56 are structured to slip over first pillow 16 and second pillow 42, respectively. As such, the first fabric material might have a tight knit, weave, or other pattern that produces a substantially smooth texture that allows first cover 54 to slip over the contours of body 18 without catching on or creating undue friction with the first foam material when in use.

Cover system 14 may further include a first outer cover 58 sized and shaped to receive first pillow 16 and base 34 within first cover 54, and a second outer cover 60 sized and shaped to receive second pillow 42 within second cover 56. In many embodiments, cover system 14 will include both first outer cover 58 and second outer cover 60, although certain embodiments may include only one outer cover 58, 60. In still other embodiments, cover system 14 might not include any outer covers 58, 60. Outer covers 58, 60 are formed of a second fabric material that is spongier, heavier, and typically thicker than the first fabric material. For instance, the second material may have a weight greater than 10 ounces per yard (i.e., approximately 339 GSM), and more particularly a weight of 11 ounces per yard (i.e., approximately 373 GSM). In an embodiment, the second fabric material may be a double knit, plural component fabric material capable of multidirectional stretch, with a stretch percentage of at least 45% in at least one direction such as a double-knit rayon/spandex/polyester blend fabric material. For instance, the second material could be a circular double knit polyester blend fabric with a 94% Polyester/6% Spandex blend having a spongy quality. As used herein, a material that is "spongy" should be understood to have generally porous construction that allows the material to compress in a direction opposite a direction of a force exerted thereon, but that is less dense and less rigid than the first foam material. In alternative embodiments, the second fabric material may be any other type of spongy fabric material and may include blends of polyester, cotton, spandex, rayon, or any other type of suitable fabric material. The frictional drag or interaction between the first and the second fabric materials during use may be less than the frictional drag or interaction between the first foam material and the first fabric material during use, and less than the frictional drag or interaction between the first foam material and the second fabric material during use. Put differently, the average frictional ratio between the first and the second fabric materials is less than the average frictional ratio between the first foam material and either of the first or the second fabric materials. As such, in some embodiments, it may be desirable to form covers 54, 56 of the second fabric material. Average frictional ratio may be understood as the ratio of an average frictional coefficient of two materials in contact with each other. Average frictional coefficient may be calculated by the following formula:

$$(F_{Kavg}+F_{Savg})/2(N)$$

wherein $F_{Kavg}$ is the average kinetic frictional resistance, $F_{Savg}$ is the average static frictional resistance, and N is the normal load.

Figure 7:
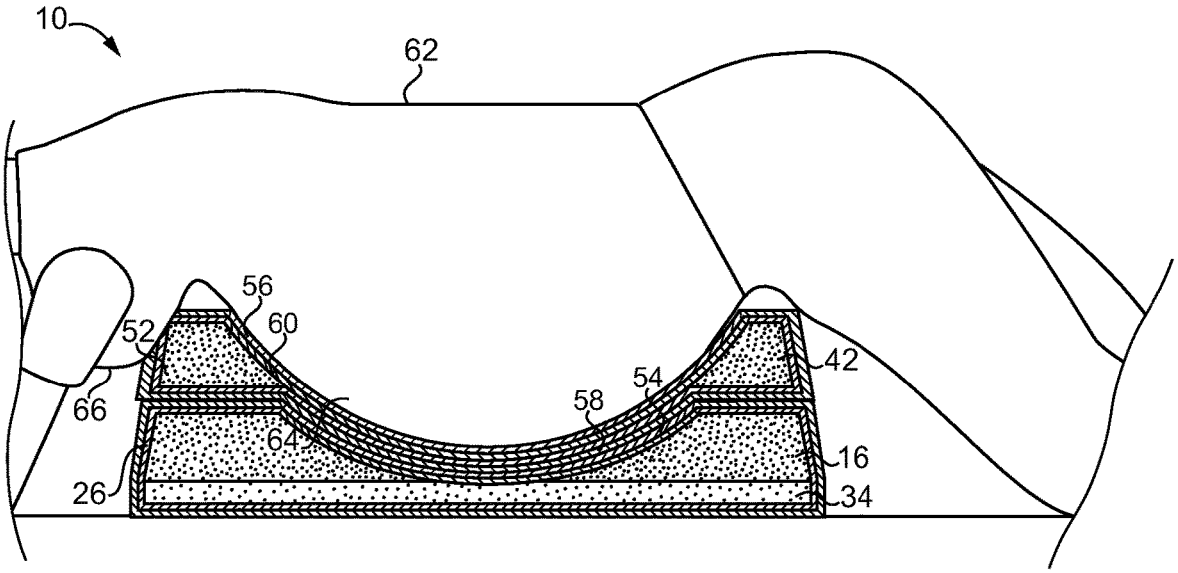
FIG. 7 is a sectioned view of a pillow system, according to one embodiment.
Figure 8:
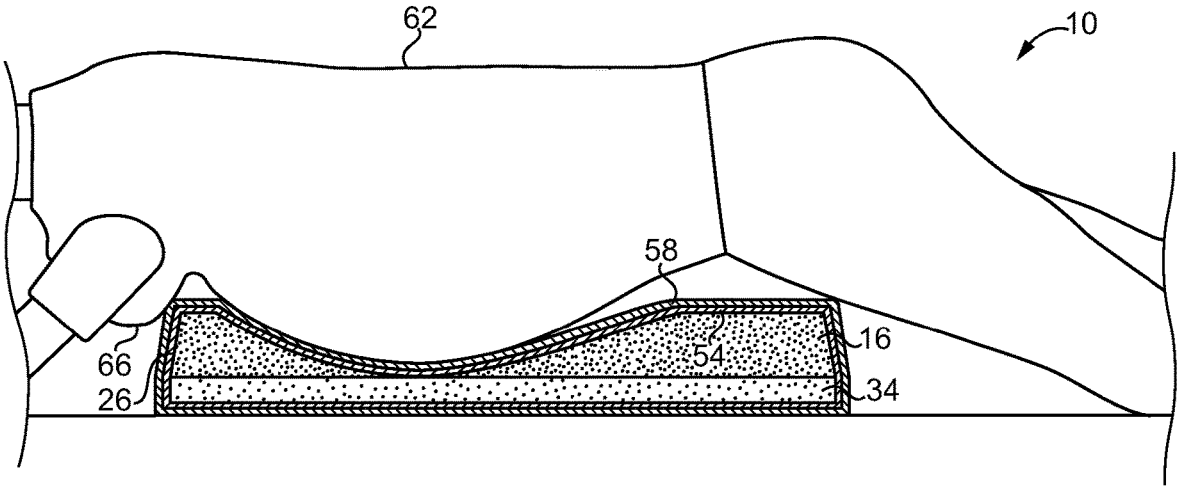
FIG. 8 is a sectioned view of a pillow system, according to one embodiment.

In a practical implementation strategy, pillow system 10 of the present embodiment may be configured to accommodate pregnant women at different stages of their pregnancies. Referring now also to FIGS. 7 and 8, pillow system 10 is shown while in use by a pregnant woman 62 according to two different configurations of the embodiment. FIG. 7 illustrates pillow system 10 in the stacked configuration also seen in FIGS. 1-6 in which second pillow 42 is positioned on top of first pillow 16. As can be seen, pillow system 10 allows a pregnant woman 62 to lie in a prone position such that her abdomen 64 is positioned within openings 20, 46. Cover system 14 stretches into openings 20, 46 to contour with and support the pregnant woman's abdomen 64, which might prevent accumulation of potentially harmful or uncomfortable forces on abdomen 64 by diffusing the pregnant woman's weight. Both covers 54, 56 and outer covers 58, 60 are structured to stretch in response to and conform with abdomen 64 to a degree that may allow abdomen 64 to come to rest on top surface 40 of base 34. The smooth texture of the first fabric material relative to the first foam material of pillows 16, 42 allows covers 54, 56 to slip over pillows 16, 42 during use, which can prevent pillows 16, 42 from becoming deformed. As the first fabric material is more stretchy and flexible (i.e., less resistant to deformation) than the first foam material, cover system 14 may also be able to diffuse load forces to a certain degree that can further prevent undue deformation of pillows 16, 42. The first fabric material might also be more stretchy and flexible than the second fabric material, but the second fabric material may still be more stretchy and flexible than the first foam material. Further still, an average kinetic frictional resistance between the first fabric material and the second fabric material may be such that the second fabric material can slip over the first fabric material during use without undue pulling or catching. It will also be appreciated opening 20 and opening 46 are positioned within body 18 and body 44, respectively, to allow the pregnant woman 62 to position herself such that her breasts 66 can rest on surfaces 26, 52.

Referring still to the drawings generally, but FIG. 8 in particular, pillow system 10 can be seen in a single (i.e., not stacked) configuration that utilizes first pillow 16, base 34, first cover 54, and first outer cover 58. Pillow assembly 12 and cover system 14 interact in substantially the same way as described above. This configuration may be desirable for use early into pregnancy, for example. In other embodiments, cover system 14 may have a number of different configurations. For example, cover system 14 may include only first cover 54 and/or second cover 56, or one or more of covers 54, 56, 58, 60 may be structured to receive more than one pillow. In some embodiments, pillow assembly 12 may include more than two pillows, or one or more dimensions of pillows 16, 42, or base 34 may be different.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. As noted above, the teachings set forth herein are applicable to a variety of different pillows, pillow covers, and pillow or pillow cover systems having a variety of different structures than those specifically described herein. Other aspects, features and advantages will be apparent upon an examination of the attached drawings and appended claims. As used herein, the articles "a" and "an" are intended to include one or more items, and may be used interchangeably with "at least one." Where only one item is intended, the term "one" or similar language is used. Also, as used herein, the terms "has," "have," "having," or the like are intended to be open-ended terms.

What is claimed is:

1. A pillow assembly comprising:

a first pillow formed of a first foam material and including a plurality of side surfaces, and an inner surface defining a first opening extending between a top surface and a bottom surface, and the top surface and the bottom surface of the first pillow being substantially planar and substantially parallel with each other;

a base having a top surface and a bottom surface, and being formed of a second foam material, the top surface of the base attached to the bottom surface of the first pillow, such that the top surface of the base extends across the first opening;

the first foam material being relatively more rigid and less deformable and the second foam material being relatively less rigid and more deformable;

a second pillow formed of the first foam material and including a plurality of side surfaces, and an inner surface defining a second opening extending between a top surface and a bottom surface that are substantially planar and substantially parallel to each other;

at least two of the plurality of side surfaces of the first pillow and at least two of the plurality of side surfaces of the second pillow slope outwardly from the respective top surface to the respective bottom surface, and each of the inner surface of the first pillow and the inner surface of the second pillow slopes inwardly from the respective top surface to the respective bottom surface; and wherein the bottom surface of the second pillow is congruent with the top surface of the first pillow, and the first pillow and the second pillow are in a stacked configuration where the second pillow is on top of the first pillow and the first opening registers with the second opening, such that the first opening and the second opening together form a tapered opening narrowing in width from the top surface of the second pillow to the base, and the second foam material forms a bottom of the tapered opening.

2. The assembly of claim 1 wherein all of the plurality of side surfaces of each of the first pillow and the second pillow slope downward at an angle.

3. The assembly of claim 2 wherein the angle is from about 5 degrees to about 25 degrees relative to a longitudinal axis extending between the top surface and the bottom surface in the respective first pillow and second pillow.

4. The assembly of claim 1 wherein a substantially continuous gradient is formed, by the respective at least two of the plurality of side surfaces in each of the first pillow and the second pillow, between the top surface of the second pillow and the bottom surface of the first pillow.

5. The assembly of claim 1 further including a pillow cover receiving the first pillow and the base, and being formed of a stretchy fabric material.

6. The assembly of claim 5 further including a second pillow cover formed of the stretchy fabric material, the second pillow cover structured to receive the second pillow.

7. The assembly of claim 6, wherein the first pillow cover fabric material and second pillow cover fabric material are less resistant to elastic deformation than the first foam material.

8. A pillow and pillow cover system comprising:

a pillow assembly including a first pillow formed of a first foam material and including a top surface, a bottom surface, a plurality of side surfaces, and an inner surface defining a first opening extending therethrough, and further including a base formed of a second foam material extending across the first opening, the first foam material being relatively more rigid and less deformable and the second foam material being relatively less rigid and more deformable;

the pillow assembly further including a second pillow formed of the first foam material and including a top surface, a bottom surface, a plurality of side surfaces, and an inner surface defining a second opening extending therethrough;

at least two of the plurality of side surfaces of the first pillow and at least two of the plurality of side surfaces of the second pillow slope outwardly from the respective top surface to the respective bottom surface, and each of the inner surface of the first pillow and the inner surface of the second pillow slopes inwardly from the respective top surface to the respective bottom surface;

a first pillow cover formed of a stretchy fabric material receiving the first pillow;

a second pillow cover formed of a stretchy fabric material receiving the second pillow; and the pillow assembly is positionable in a stacked configuration of the second pillow upon the first pillow where the second opening is in register with the first opening, such that the first opening and the second opening together form a tapered opening narrowing in width from the top surface of the second pillow to the base, and the second foam material forms a bottom of the tapered opening.

9. The system of claim 8 wherein the stretchy fabric material has a stretch percentage of at least 65%.

10. The system of claim 8 wherein each of the first pillow cover and the second pillow cover is an inner cover and the stretchy fabric material is a first fabric material, and each of the first pillow cover and the second pillow cover further including an outer cover formed of a second fabric material receiving the pillow assembly housed within the respective inner cover, and wherein the first fabric material is not spongy and the second fabric material is spongy.

11. The system of claim 8 wherein the top surface and the bottom surface of each of the first pillow and the second pillow are substantially planar and, respectively, substantially parallel with each other.

12. The system of claim 8 wherein, in each of the first pillow and the second pillow, the respective plurality of side surfaces are oriented such that the pillow assembly has a substantially continuous gradient between the top surface of the second pillow and the bottom surface of the first pillow.

13. A pillow system comprising:

a first pillow formed of a first foam material and defining a first opening, and the first pillow including a top surface, a bottom surface, and side surfaces sloping outwardly from the top surface to the bottom surface;

a second pillow formed of the first foam material and defining a second opening, and the second pillow including a top surface, a bottom surface, and side surfaces sloping outwardly from the respective top surface to the respective bottom surface, and the second pillow structured for positioning on top of the first pillow in a stacked configuration of the pillow system;

a base formed of a second foam material and attached to a bottom side of the first pillow such that the second foam material extends across the first opening, the first foam material being more rigid than the second foam material;

the second pillow including a top surface, a bottom surface, and side surfaces sloping outwardly from the top surface to the bottom surface, and in the stacked configuration the second opening and the first opening together form a tapered opening narrowing in width from the top surface of the second pillow to the base;

a first pillow cover receiving the first pillow and the base, the first pillow cover being formed of a stretchy fabric material; and a second pillow cover formed of the stretchy fabric material receiving the second pillow;

wherein the first pillow cover fabric material and second pillow cover fabric material are more flexible than the first foam material.

14. The system of claim 13 wherein the first pillow cover and the second pillow cover are a first inner cover and a second inner cover, respectively, and the stretchy fabric material is a first fabric material, and the system further includes an outer cover formed of a second fabric material receiving the first pillow and the base within the first inner cover, the second fabric material being spongy relative to the first fabric material.

15. The system of claim 14 further including a second outer cover formed of the second fabric material receiving the second pillow within the second inner cover.

16. The system of claim 13 wherein the second foam material has an indentation force deflection of less than or equal to 45 pounds.

* * * * *